US005414989A

United States Patent [19]

Rader et al.

[11] Patent Number: 5,414,989

[45] Date of Patent: May 16, 1995

[54] THREE DISK SET FRICTION FALSE-TWISTING UNIT WITH SWUNG OUT SET OF DISKS

[75] Inventors: Wolfgang Rader, Schonungen; Walter Vogel, Niederwerrn, both of Germany

[73] Assignee: TEMCO Textilmachinenkomponenten GmbH & Co. KG, Germany

[21] Appl. No.: 31,935

[22] Filed: Mar. 15, 1993

Related U.S. Application Data

[63] Continuation of Ser. No. 645,263, Jan. 24, 1991, abandoned.

[30] Foreign Application Priority Data

Jan. 24, 1990 [DE] Germany ..... 40 01 957.8

[51] Int. Cl.[6] ..... D01H 7/92; D01H 13/00

[52] U.S. Cl. ..... 57/339; 57/348

[58] Field of Search ..... 57/339, 340, 348, 334, 57/337, 338

[56] References Cited

U.S. PATENT DOCUMENTS 4,047,374 9/1977 Venot ..... 57/338
4,143,252 1/1979 Otaki et al. ..... 57/348 X
4,240,248 12/1980 Raschle ..... 57/339 X
4,442,664 4/1984 Schmitt et al. ..... 57/348
4,485,617 12/1984 Schmitt et al. ..... 57/104 X
4,704,858 9/1987 Naylor et al. ..... 57/339 X

FOREIGN PATENT DOCUMENTS 2377463 9/1978 France ..... 57/339

*Primary Examiner*—Daniel P. Stodola
*Assistant Examiner*—William Stryjewski
*Attorney, Agent, or Firm*—Ostrolenk, Faber, Gerb & Soffen

[57] ABSTRACT

A linear course of thread is required for a high speed friction false-twisting unit. For this purpose, the region of travel of the thread through the center of a three spindle disk set triangle should be freely accessible. One of the disk sets is adapted to be swung out on a lever from the other two disk sets. A toothed belt drive is used both in the case of a tangential belt drive and in units driven by an electric motor. A further advantage is that this arrangement can be used in units which have the possibility of a change of the center-to-center distance. The belts from driving rollers which drive the disk set spindles are held outside the center of the disk triangle through which the thread passes.

31 Claims, 8 Drawing Sheets

THREE DISK SET FRICTION FALSE-TWISTING UNIT WITH SWUNG OUT SET OF DISKS

This is a continuation of application Ser. No. 07/645,263, filed on Jan. 24, 1991, now abandoned.

BACKGROUND OF THE INVENTION

Friction false-twisting units are well known for texturing thread. They have drawing off speeds of up to 800 m/min. Increases in the drawing off speed cause difficulties, among other reasons, because the thread cannot be guided on a straight path through the false twisting unit. The traditional drives for the disk sets of the unit block up the middle of the unit so that the thread experiences a deflection which is disadvantageous at high speeds. Another condition for units with high drawing off speeds is the ability to open the unit, i.e. it must be possible to swing one set of the disks out of the triangle defined by the three sets of disks carried on three spindles. It has been found in practice that, upon arrival of the thread, two sets of disks should already be in operation in order better to carry the thread along. It is therefore not sufficient to open all three sets of disks. See German application DE 2 213 147.

European application EP 02 19 246 A1 shows a false twisting unit adapted to be opened. In that case, the thread can be inserted. But, due to the toothed belt drive, the thread must be deflected after or before leaving the disk wedge. This disadvantage permits only slightly higher draw off speeds.

SUMMARY OF THE INVENTION

The object of the present invention is to provide a false-twisting unit having a straight course of the thread, in which one set of false twisting disks is swung out and the other two may already be in engagement with thread.

In order to obtain completely straight travel of the thread in a high speed false-twisting unit, the center of the disk triangle must be free of any drive transmission belt. The drive for such a unit can be effected via a tangential belt or else via an individual motor for the unit. Furthermore, it must be taken into consideration whether the unit is to be used with a fixed center-to-center distance, i.e. an invariable disk set triangle, or with a variable distance between disk set centers.

In accordance with the invention, four combinations of belts, and preferably toothed belts, are needed to operate the disk sets from their operating means.

Four embodiments of the invention are disclosed.

One distinguishes between a) fixed center tangential belt drive; b) fixed center motor drive; c) axially displaceable tangential belt drive, and d) axially displaceable motor drive.

In the case of a fixed center false twisting unit with a tangential belt drive, the drive whorl is arranged outside of the disk set triangle of the false twisting unit. Preferably, there are two drive whorls, one in front of the tangential belt for applying an S-twist, and one behind the tangential belt for applying a Z-twist. From the selected operative drive whorl, a first toothed belt is guided over a first toothed disk on the shift of the drive whorl to a second toothed disk. The second disk is connected with, e.g. it is on the same shaft as a third toothed disk. From the third toothed disk, a second toothed belt extends to a first corner roller mounting, which is arranged to one side, e.g. toward the right side of the false-twisting unit. The first corner roller bears a fourth toothed disk. From the fourth disk, the second belt extends to a fifth toothed disk which is fastened on the texturing disk mounting of the rear disk set and drives it. The return path of the second toothed belt extends over a second corner roller arranged on the left, by extending over a sixth toothed disk on the same shaft as the second corner roller and thereafter back to the third toothed disk. The fourth toothed disk is coupled to a seventh toothed disk by a third toothed belt, to drive the front angle set of texturing disks when the third belt engages an eighth toothed disk. The sixth toothed disk on the left is coupled to a ninth toothed disk on the same shaft. From the ninth disk, the left front texturing disk set is driven by a fourth toothed belt which passes over the ninth disk and then over the tenth toothed disk on the left front disk set.

The unit may be pivoted open by a lever on which the left disk set is mounted to pivot open around a pivot point which is arranged at the mounting of the sixth toothed disk. The rear and right disk sets remain in their unpivoted positions. By this arrangement of toothed belts, the rear and right disk sets can be already operating during the insertion of the thread. The path for the thread through the center of the disk triangle is still entirely free of belt drives and other elements, and this assures a precisely linear travel of the thread.

If this false-twisting unit is driven by an electric motor rather than by a belt, then the first and second toothed disks, as well as the first toothed belt, are eliminated. The third toothed disk is seated on the shaft of the motor. From there, the second toothed belt introduces the drive to the disk sets, as already described. The further course of the toothed belts is identical to the unit driven by the tangential belt.

In another embodiment which, in addition to the opening of the unit, also permits displacement of the equilateral triangle, i.e. adjustment of the center-to-center distance of the disk sets, the drive whorls are arranged within the false-twisting unit rather than outside the disk triangle. The drive whorl for applying an S-twist is arranged in front of the tangential belt on the mount or spindle of the front right disk set. The drive whorl for applying a Z-twist is arranged on the mount or spindle of the rear disk set behind the tangential belt.

The front right disk set bears the drive whorl. The first toothed disk is also installed on that disk set. The first toothed belt extends from the front, right disk set to drive the second toothed disk at the rear right corner roller mounting. The latter mounting is coupled with a third toothed disk on its shaft. A second toothed belt passes over the third disk and drives the central rear disk set via a fourth toothed disk on that rear disk set. A fifth toothed disk is coupled with the second and third toothed disks by being on the same shaft. The sixth toothed disk of the left rear corner roller is driven by a third toothed belt that passes over the fifth and sixth toothed disks. The sixth toothed disk is coupled with a seventh toothed disk on the same shaft. The front left disk set bears the eighth toothed disk. The seventh toothed disk drives the eighth disk via a fourth toothed belt. The pivot point for the opening of the unit by means of the lever which is applied on the left and which also bears the front left disk set lies in the rear left corner roller mount.

In the case of Z-twist, the drive takes place from a drive whorl on the central rear disk set mounting. The further arrangement of the toothed belts is not changed from the above discussed embodiment. Also, in the case of this guidance of the toothed belts, the path of the thread is absolutely free so that completely straight travel of the thread is assured. In the front right region, the possible change in the center-to-center distance is indicated, which can also take place, however, via gauge.

In the embodiment just described, but driven by an electric motor rather than by a tangential belt, the third toothed belt is replaced by a lengthened toothed belt. On the rear wall of the base plate of the false-twisting unit, a separable bracket which bears the electric motor is attached by flange. A ninth toothed disk seated on the motor shaft is engaged by the lengthened third toothed belt to drive the fifth toothed disk of the right rear corner roller and, via the sixth toothed disk, to drive the left rear corner roller. The further courses of the toothed belts is identical to the tangential belt unit described above. It is also possible to interchange the types of drives by replacing the drive supporting brackets of the unit, and thus change the course of the toothed belt in the different versions.

Other features and advantages of the present invention will become apparent from the following description of the invention which refers to the accompanying drawings.

BRIEF DESCRIPTION OF THE DRAWINGS

The invention will be explained in further detail with reference to examples. In the drawing.

DETAILED DESCRIPTION OF THE DRAWINGS

Figure 1:
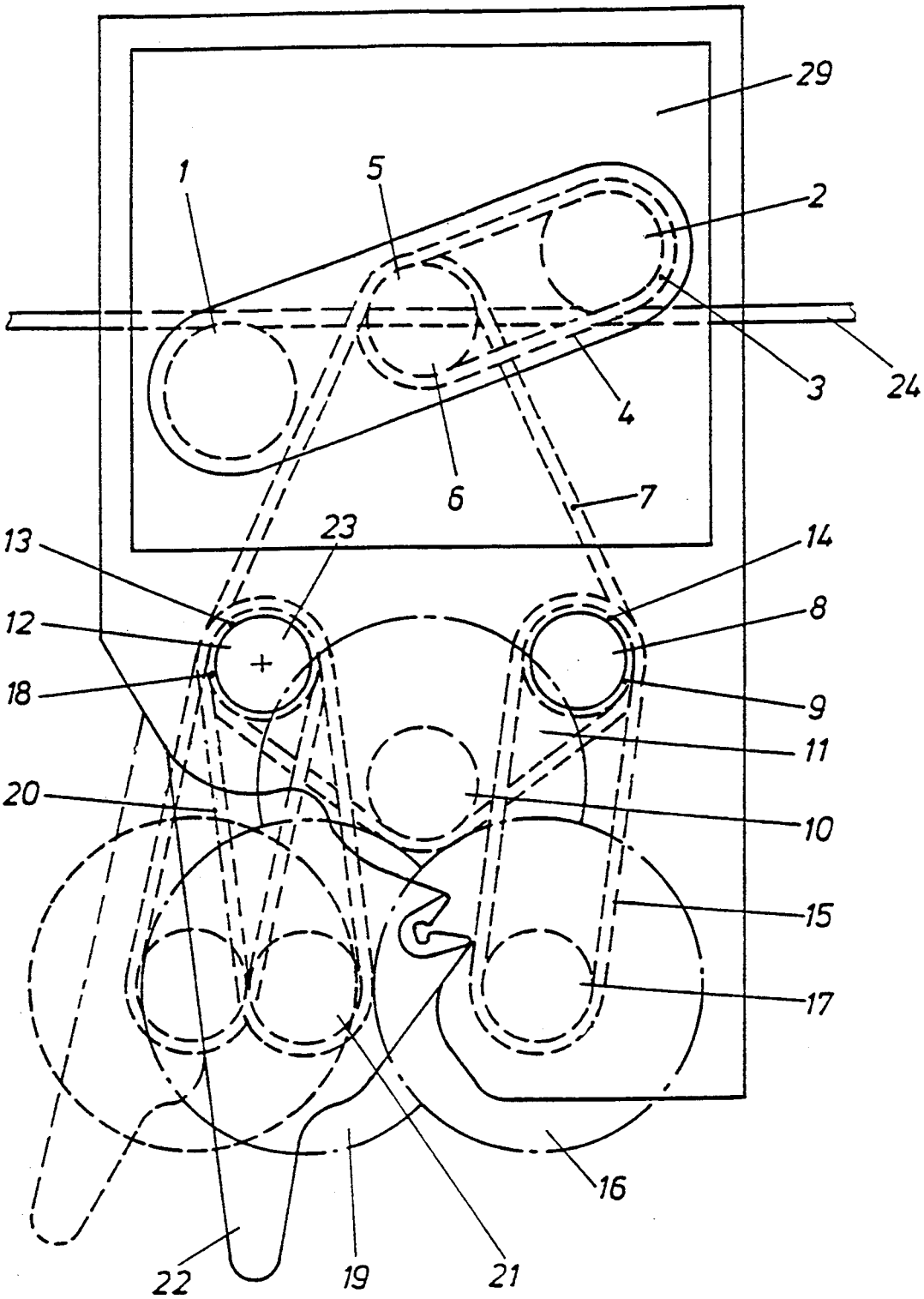
FIG. 1 is a top view of a high speed friction false-twisting unit in closed and open condition with a toothed belt arrangement without change of center-to-center distance and driven by a tangential belt.
Figure 2:
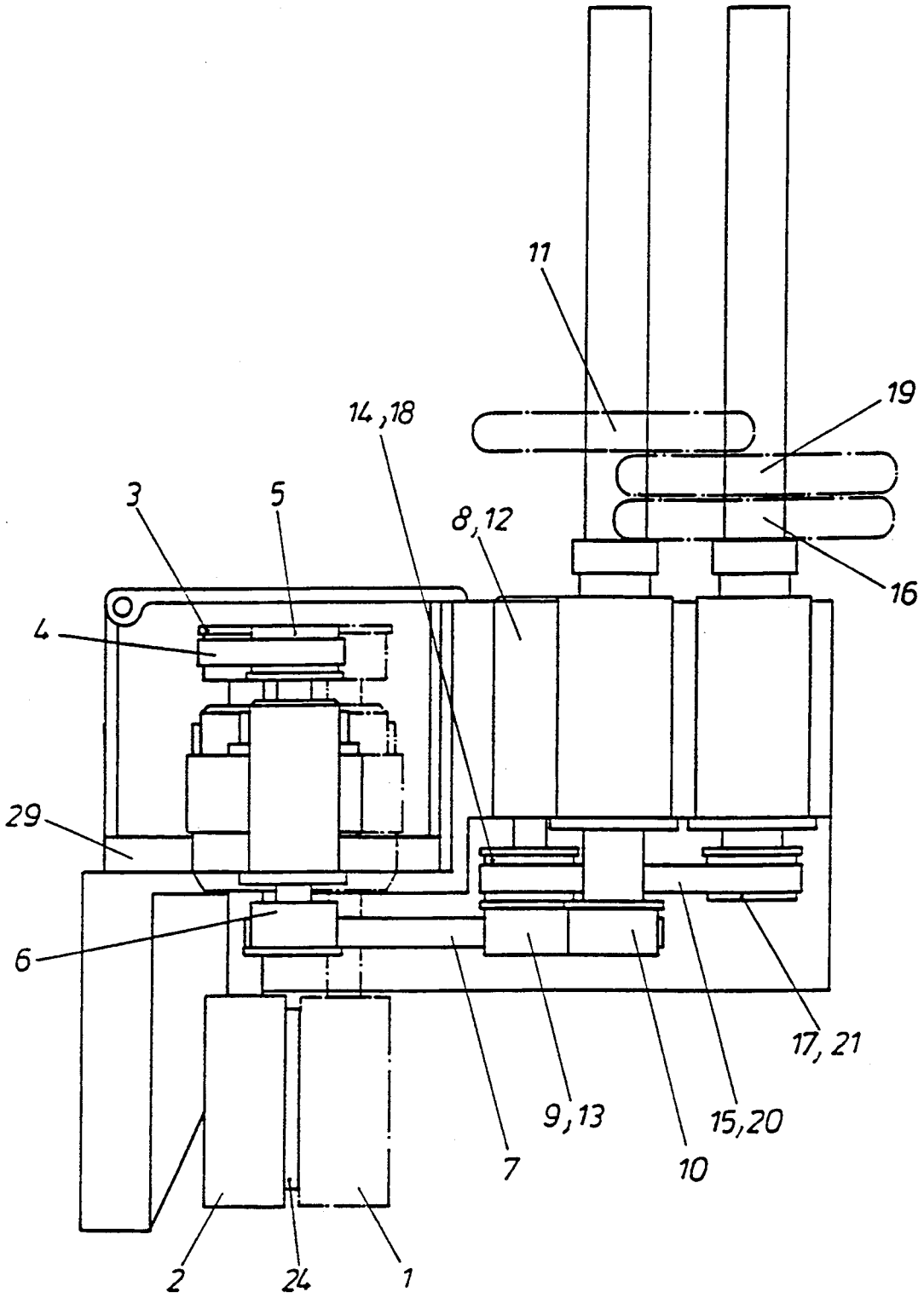
FIG. 2 is a side view of FIG. 1 with the toothed-disk and toothed-belt arrangement.

An embodiment of a high speed friction false-twisting unit is shown in FIGS. 1 and 2. In this description, the terms "above" and "below" refer respectively to the top and bottom of FIG. 2. The drive whorl 2 below is coupled on a common drive shaft with the toothed disk 3 above. The whorl 2 is driven by the tangential belt 24 which in turn rotates the toothed disks on the common shaft with the drive whorl. The toothed disk 5, which is also above, is driven by the toothed disk 3 via the toothed belt 4 passing between those disks. The toothed disk 6 is on a common shaft with and rotates with the disk 5, and is above the drive whorl 2 and above the belt 24. The toothed belt 7 passes over and is driven by the toothed disk 6. The corner roller 8 for the front right disk set 16 is on a common shaft with the toothed disk 9. The disk 9 and therefore the roller 8 is driven by the toothed disk 6 through the driven toothed belt 7.

The rear disk set 11 is driven by the toothed disk 9 through the driven belt 7. The toothed belt 7 returns from the disk 9 over the toothed disk 10 for the rear disk set 11, to drive the corner roller 12 for the left front disk set 19, by means of the toothed disk 13 which is on a common shaft with the driven corner roller 12.

The toothed disk 9 is on the same shaft with or is otherwise coupled to the toothed disk 14 above the disk 9. The front right disk set 16 is driven by the toothed belt 15 which engages the disk 14 and wraps over the toothed disk 17 which is on a common shaft with the disk set 16.

The toothed disk 13 for the corner roller 12 is driven by the belt 7. The disk 13 is coupled to another toothed disk 18 that is above the disk 13 on a common shaft. From the disk 18, the left front disk set 19 is driven via the toothed belt 20 which wraps over the toothed disk 21 which is on a common shaft with the disk set 19.

A lever 22 supports the disk set 19 and its shaft and the disks thereon. The lever 22 is moveable around a pivot point 23 located at the center of the corner roller 12. No matter how the lever 22 is pivoted, the spacings between any two disks joined by a belt remains unchanged and belt tensions are unaffected.

FIG. 2 is a side view of the unit of FIG. 1. The basic drive of the unit takes place over either drive whorl 1 or 2 by the tangential belt 24 which engages the selected whorl. From the drive whorl, the drive is shifted upward to the toothed disks 3 and 5 which are joined by the toothed belt 4. From the toothed disk 5 above, further drive is effected downward on a common shaft to the toothed disk 6. Via the toothed belt 7 the rear disk set 11 is driven by the disk 6. The toothed belt 7 also drives the corner rollers 8 and 12 through their respective toothed disks 9 and 13. The toothed disks 9 and 13 are respectively coupled to the toothed disks 14 and 18 by also being on a common shaft with the respective toothed disks. The front right disk set 16 is driven by the toothed disk 14 through the toothed belt 15 acting on the toothed disk 17 on a common shaft with the disk set 16.

For the front left disk set of the unit, the toothed disk 13 is coupled to the toothed disk 18 because they are on a common shaft. From there the disk set 19 is driven by the toothed belt 20 which wraps over the toothed disk 18 and the toothed disk 21.

Figure 3:
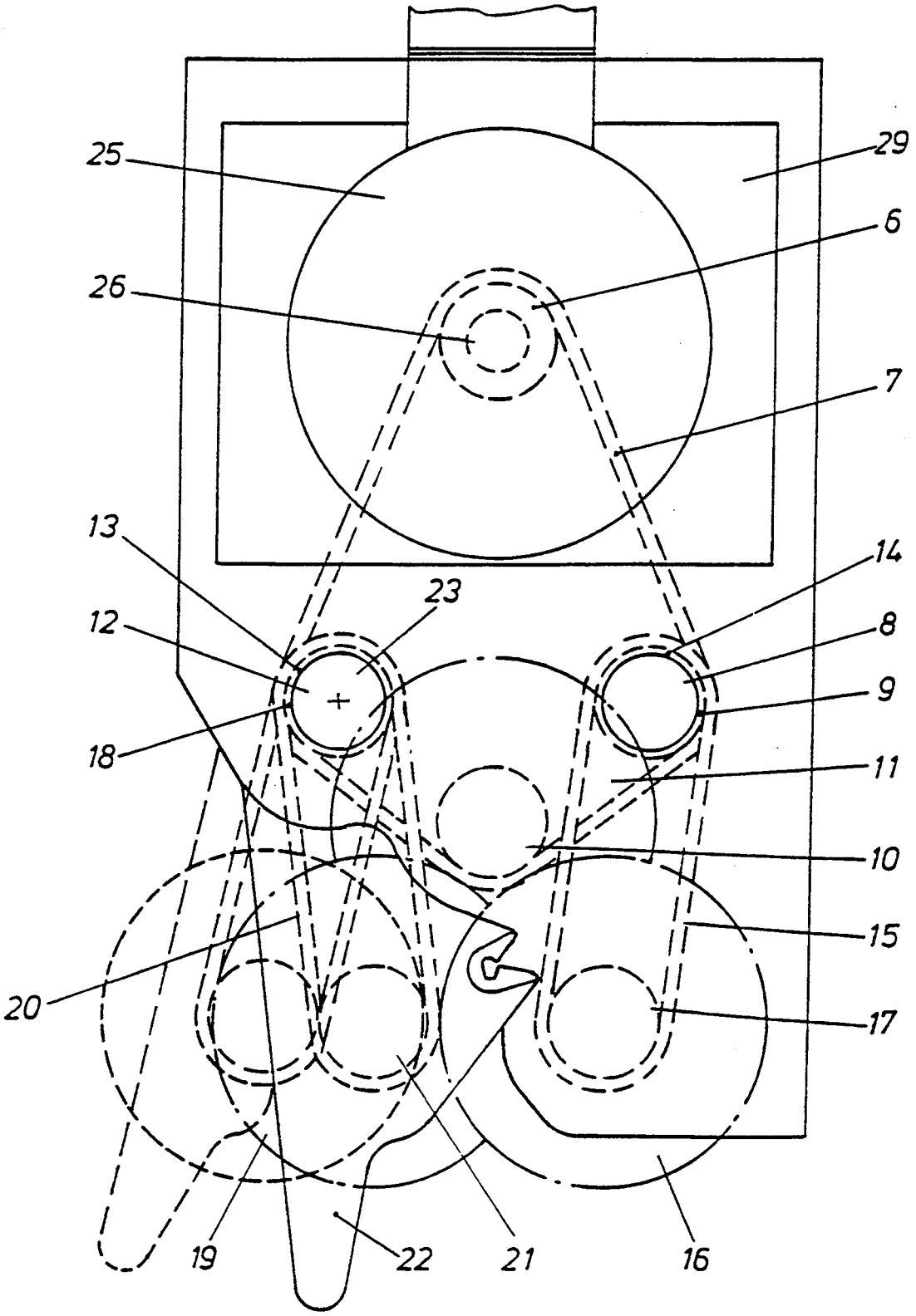
FIG. 3 is a top view of a high speed friction false-twisting unit in closed and open condition with the toothed-belt arrangement and an electric motor drive, without change of center-to-center distance.

FIG. 3 shows the type of false-twisting unit described above and shown in FIG. 1, but with an electric motor drive. The toothed disk 6 is fastened on the motor shaft 26 of the electric motor 25. The rear disk set 11 is driven through its toothed disk 10 by the lengthened toothed belt 7 which also wraps over the corner rollers 8 and 12. The corner rollers 8 and 12 are on the same shafts as the toothed disks 9 and 13, respectively. The further drives to the disk sets 16 and 19 are effected in the manner described with reference to FIG. 1.

Figure 4:
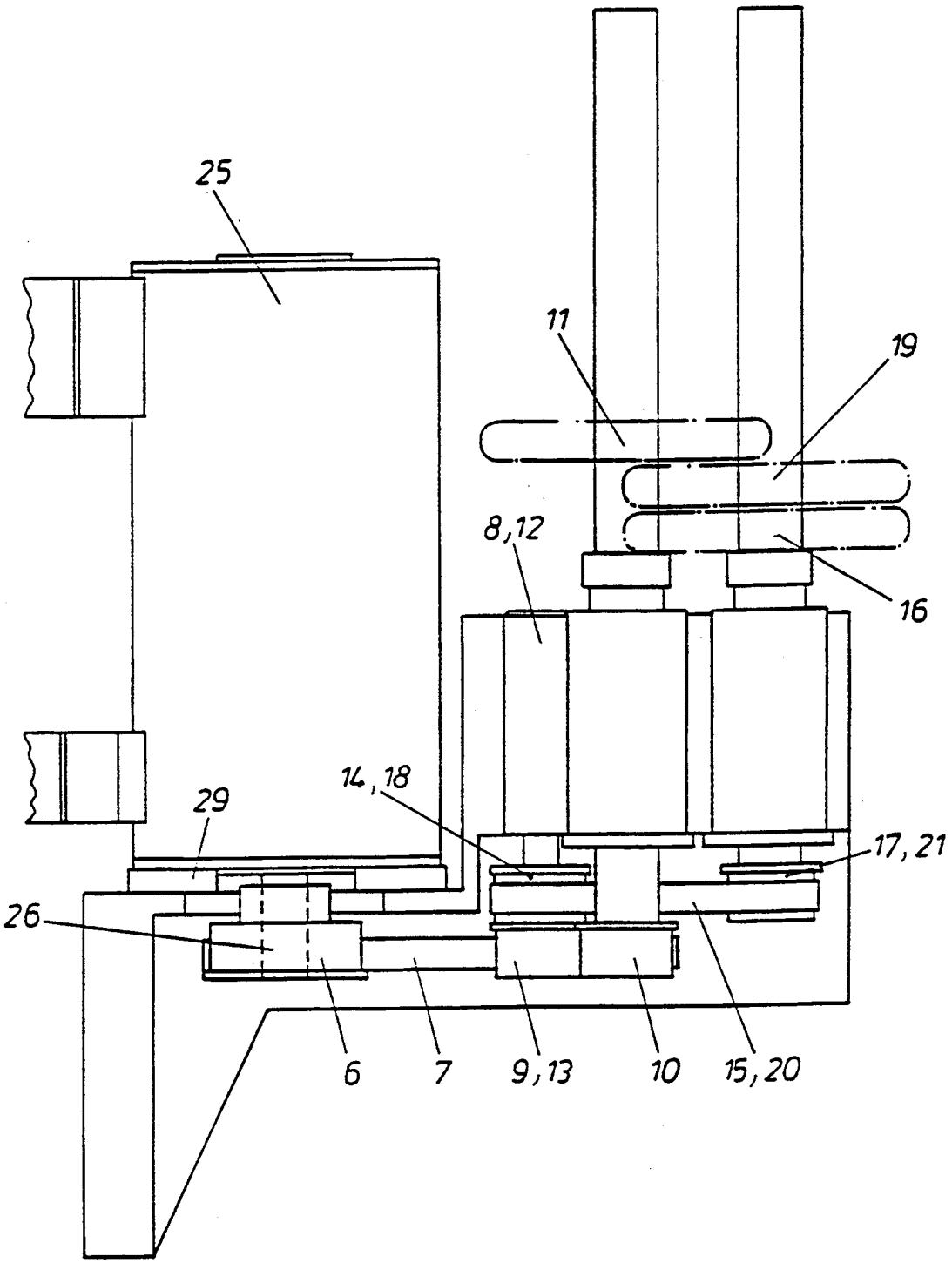
FIG. 4 is a side view of FIG. 3 showing the toothed disk and toothed belt arrangement.

FIG. 4 is a side view of the embodiment of FIG. 3. This shows that the toothed disk 6 fastened on the motor shaft 26 of the electric motor 25 drives the disk set 11 through its toothed disk 10 by means of the toothed belt 7. The belt 7 wraps around the toothed disks 9 and 13, and this drives the corner rollers 8 and 12. The further course of the drive is identical to that described in connection with FIG. 2.

Figure 5:
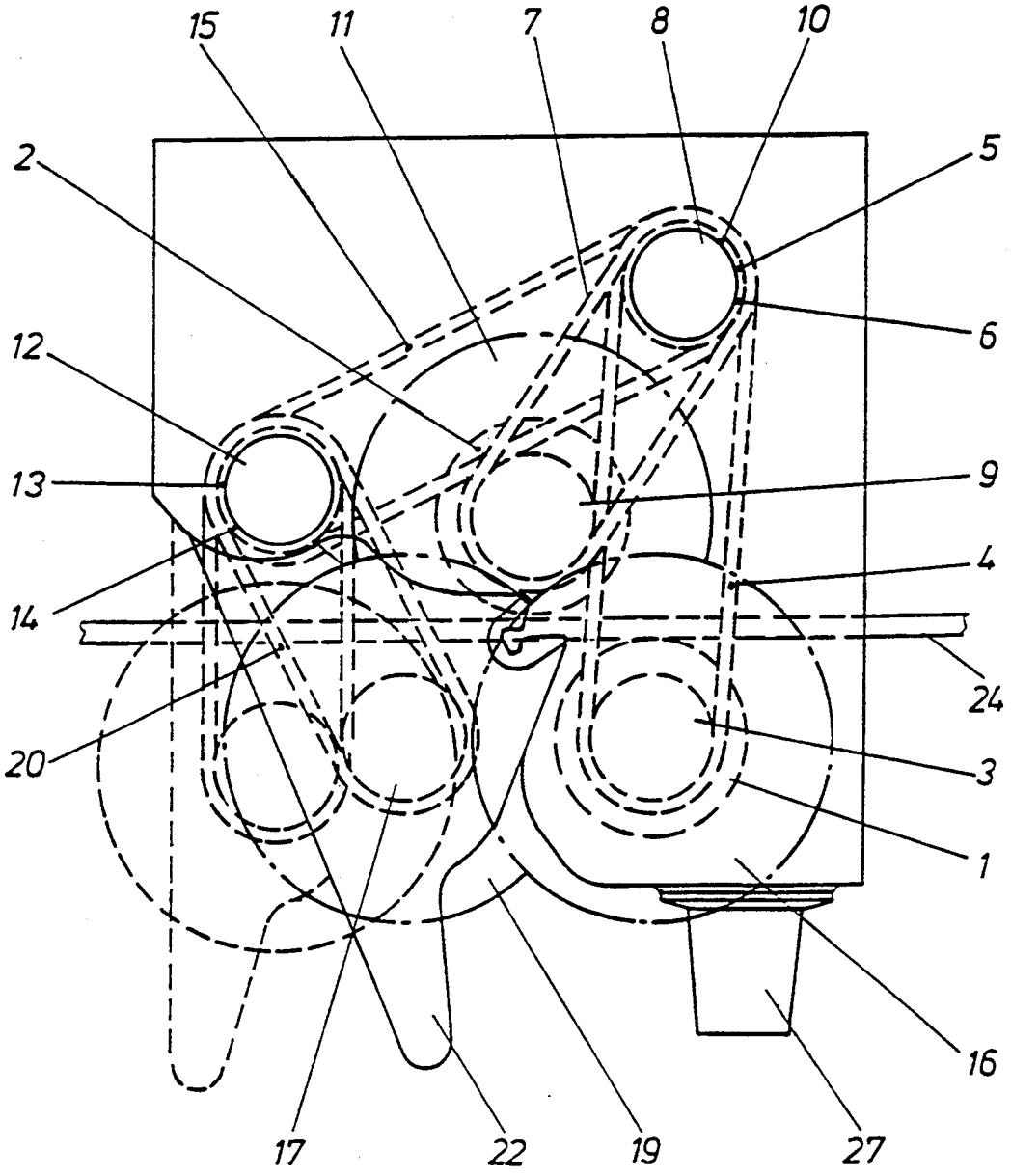
FIG. 5 is a top view of a high speed friction false-twisting unit in closed and open condition with a tangential belt drive and the toothed-belt arrangement with the possibility of changing the center-to-center distance.

FIG. 5 is a top view of a high speed friction false-twisting unit with means 27 for possibly changing the center-to-center distance of the disk sets. The means 27 are not here explained further, since such means are known in the art. There are two drive whorls 1 and 2 arranged within the disk triangle of the false-twisting unit, rather than outside the unit as in FIG. 1. The drive whorl 1 for S-twist is located in front of the tangential belt 24. The drive whorl 2 for Z-twist is located behind the tangential belt 24. Either or both of the false twist unit and its drive whorls or the tangential belt are adjusted so that only one drive whorl 1 or 2 is engaged.

The drive whorl 1 is coupled to the front right disk set 16 by being on the same shaft with that disk set and with the toothed disk 3. From the drive disk 3, the corner roller 8 is driven by the toothed belt 4 which engages the toothed disk 5 located on the shaft with the corner roller 8.

Another toothed disk 6 is fastened on the corner roller 8. The disk 6 drives the rear disk set 11 through the toothed belt 7 driving the toothed disk 9 on the shaft of the rear disk set. Another toothed disk 13 is fastened on the shaft of the corner roller 12. A toothed belt 15 is wrapped over the toothed disks 10 and 13 so that the toothed disk 13 is driven by the toothed belt 15. A toothed disk 14 is on the shaft of the corner roller 12. A toothed disk 17 is on the shaft of the disk set 19. The disk set 19 is driven by the toothed belt 20 wrapped over the disks 14 and 17.

The lever 22 is to be opened. Its pivot point is at the corner roller 12. The disk set 19 is on the lever 22.

Figure 6:
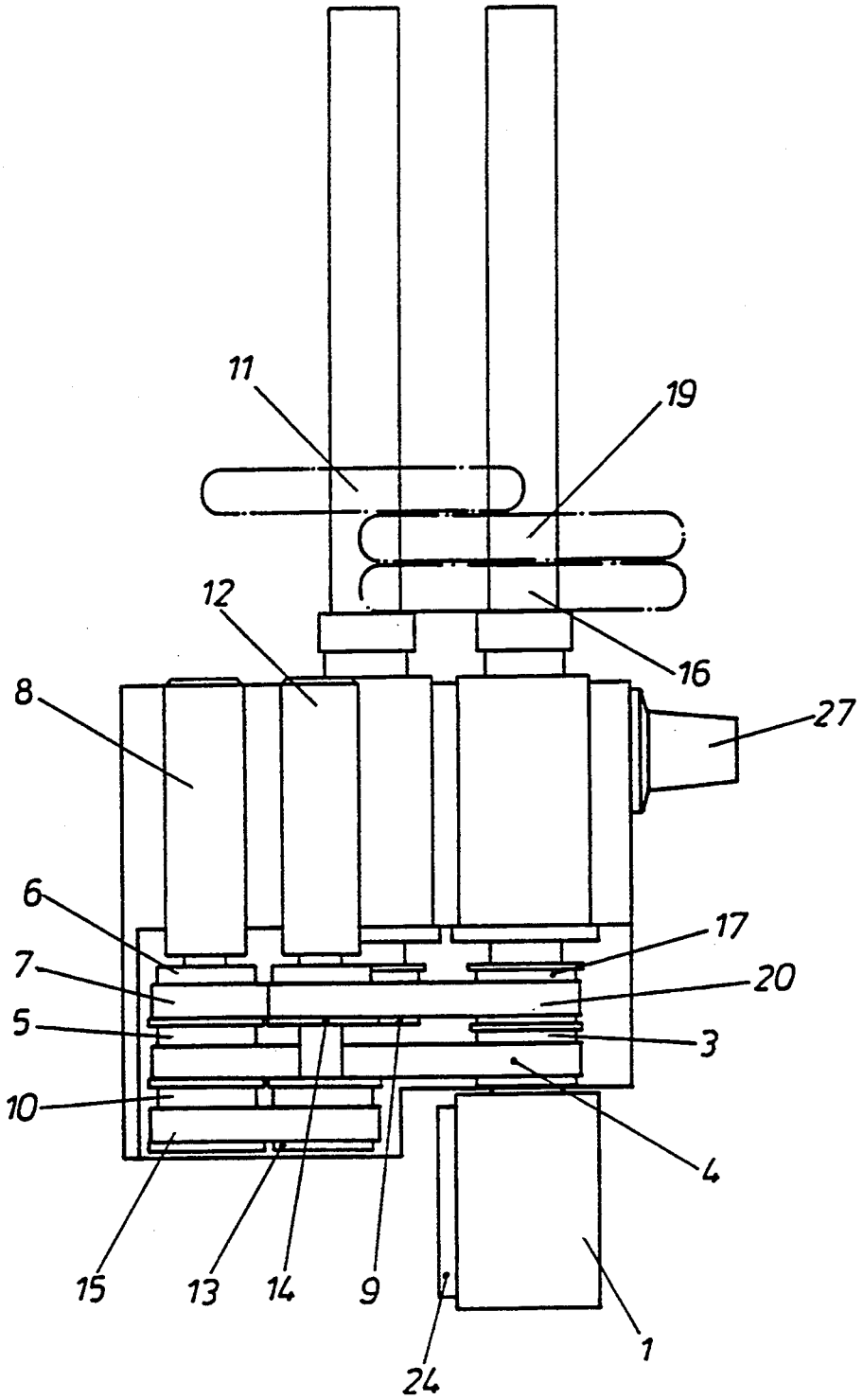
FIG. 6 is a side view of FIG. 5 showing the toothed disk and toothed belt arrangement.

FIG. 6 is a side view of FIG. 5. The toothed belt arrangement lies in three horizontal planes below the false twist unit. Starting from the drive whorl 1 which is driven by the tangential belt 24, the toothed disk 3 is fastened above the whorl. By means of the toothed belt 4 which wraps the disks 3 and 5, corner roller 8 is rotated. The toothed disk 6 is also fastened on the corner roller 8. By means of a toothed belt 7, the toothed disk 9 is driven and in turn drives the disk set 11. A third toothed disk 10 also fastened on the corner roller 8 is in a third plane. The toothed belt 15 wraps the toothed disk 10 and the toothed disk 13, and the corner roller 12 is thereby driven. The further toothed disk 14 fastened on the corner roller 12 is back in the first plane. The toothed disk 17 is on the shaft of the disk set 19. The toothed belt 20 drives the disk set 19 through the toothed disk 17.

Figure 7:
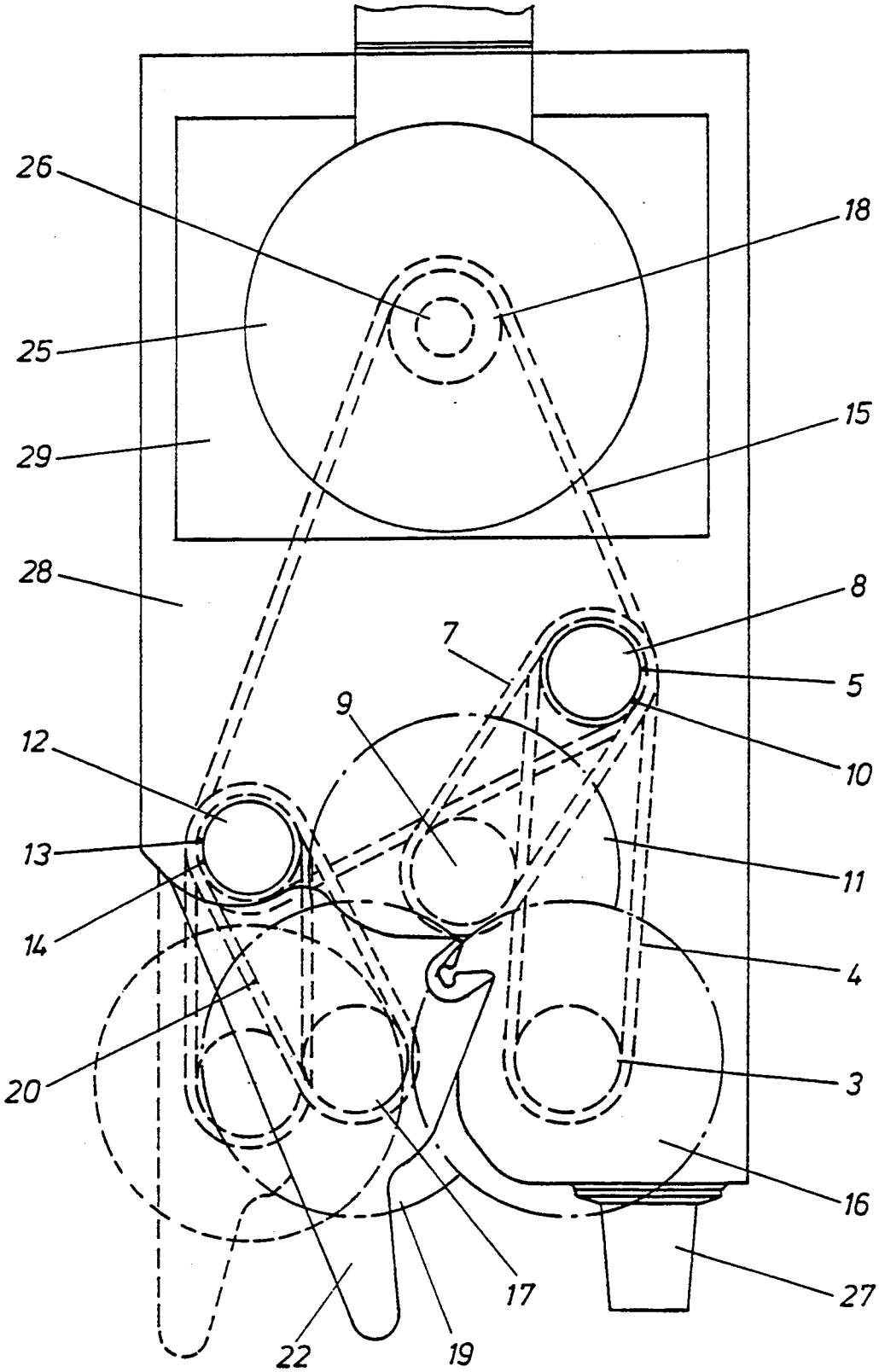
FIG. 7 is a top view of the high-speed friction false-twisting unit driven by electric motor in closed and open condition with the possibility of changing the center-to-center distance.

FIG. 7 shows the high-speed friction false-twisting unit described in FIGS. 5 and 6, in association with an electric motor drive. The toothed belt 15 is elongated, as compared with the corresponding belt 15 in FIG. 5. The belt 15 is wrapped on the toothed disk 18, which is fastened on the motor shaft 26 of the motor 25. The belt 15 drives the two corner rollers 8 and 12 via the respective toothed disks 10 and 13 on those corner rollers. The rest of the course of the drive is the same as in FIG. 5.

Figure 8:
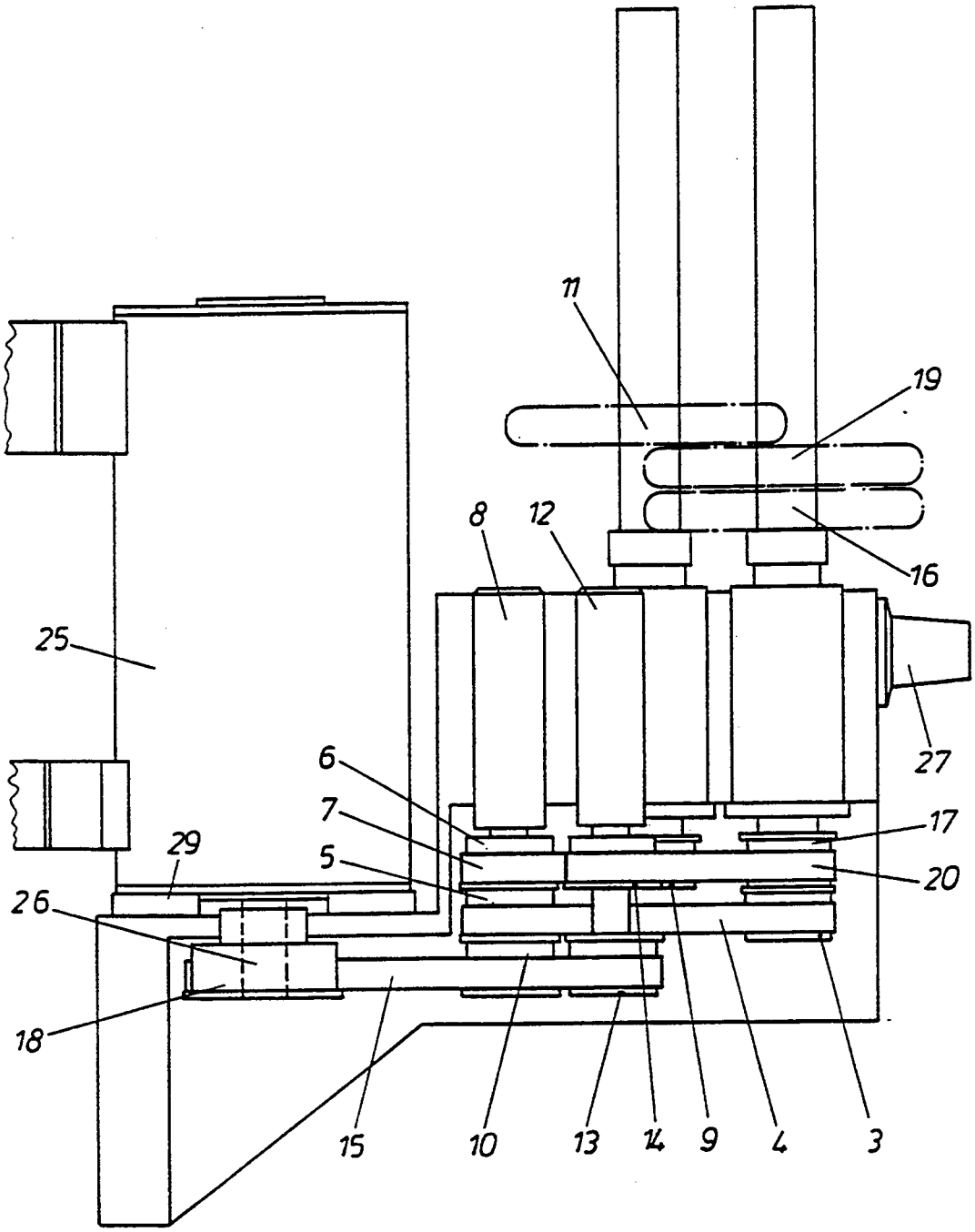
FIG. 8 is a side view of FIG. 7 showing the toothed disk and toothed belt arrangement.

FIG. 8 is a side view of the unit of FIG. 7. The toothed disk 18 is fastened on the motor shaft 26 of the motor 25. From the disk 18 the toothed belt 15 drives the corner rollers 8 and 12 via the respective toothed disks 10 and 13. The rest of the toothed belt arrangement is identical to that in FIG. 6.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A false twisting unit comprising first, second and third parallel spindles, the spindles having axial centers which define apexes of an equilateral disk triangle having a center, each of the spindles having a respective set of false twisting disks;

one of the spindles and the respective disk set thereon being openable away from the other disk sets for providing an access opening extending parallel to the spindle axes and extending from an exterior point laterally spaced from the spindles, to the center of the disk triangle, for enabling insertion of a thread laterally from the exterior point, past the disks in the disk sets, to the center of the disk triangle for being guided through the false-twisting unit during operation thereof; and driving means for driving the disk sets to rotate, the driving means comprising:

rotation receiving means for being rotated by a prime mover;

a first corner roller located outside the center of the disk triangle; and belt means for interconnecting the rotation receiving means, the first corner roller, and the first, second and third spindles;

the belt means interconnecting the rotation receiving means and the first corner roller for rotating the first corner roller as the rotation receiving means is rotated;

the belt means interconnecting the first corner roller and the first spindle such that rotation of the first corner roller rotates the first spindle and the first disk set thereon;

the belt means interconnecting the first corner roller and the second spindle such that rotation of the first corner roller rotates the second spindle and the second disk set thereon; and the belt means travelling outside and not obstructing the access opening to the center of the disk triangle, thereby providing unobstructed lateral access for the thread to the center of the disk triangle.

2. The false twisting unit of claim 1, wherein the rotation receiving means comprises a drive whorl for being rotated by a drive belt.

3. The false twisting unit of claim 2, wherein the belt means further interconnects the first corner roller and the third spindle such that rotation of the corner roller rotates the third spindle and the third disk set thereon.

4. The false twisting unit of claim 3, further comprising a second corner roller spaced from the first corner roller and also located outside the disk triangle;

the belt means interconnecting the first and second corner rollers such that the first and second corner rollers rotate together.

5. The false twisting unit of claim 4, wherein the belt means includes a single loop belt driven by the drive whorl and passing over the first corner roller, the third spindle and the second corner roller for causing those elements to rotate together.

6. The false twisting unit of claim 2, wherein the drive whorl is on the third spindle for rotating the third spindle and third disk set thereon.

7. The false twisting unit of claim 2, wherein the belt for the drive whorl comprises a tangential drive belt for tangentially engaging the drive whorl.

8. The false twisting unit of claim 2, wherein the openable spindle and the respective disk set thereon that are openable away from the other disk sets is one of the second and third spindles with the respective disk set thereon, and the openable spindle is supported to the false twisting unit for being swung away from the other spindles for enabling insertion of a thread through the disk sets with the one disk set open away from the others.

9. The false twisting unit of claim 2, further comprising a second corner roller spaced from the first corner roller and also located outside the center of the disk triangle; the belt means interconnecting the first and second corner rollers such that the first and second corner rollers rotate together.

10. The false twisting unit of claim 9, wherein the belt means between the first and second corner rollers comprises a belt extending between those corner rollers and outside the center of the disk triangle.

11. The false twisting unit of claim 9, wherein the drive whorl is on one of the first and third spindles and the belt means comprises a belt from the drive whorl to the first corner roller;

the belt means extending between the corner roller and the other of the first and third spindles from which the drive whorl is absent.

12. The false twisting unit of claim 2, wherein the belt means to the corner roller comprises a rotating disk on the drive whorl and a belt between the rotating disk and the corner roller;

further comprising a separate bracket, separable from the false twisting unit, the rotating disk being fastened on the separable bracket for being separated from the false twisting unit with the separable bracket.

13. The false twisting unit of claim 1, further comprising a drive motor, and the rotation receiving means comprising a drive shaft of the drive motor.

14. The false twisting unit of claim 13, wherein the rotation receiving means further comprises a rotating disk on the drive shaft.

15. A false twisting unit comprising first, second and third parallel spindles, the spindles having axial centers which define apexes of an equilateral disk triangle having a center, each of the spindles having a respective set of false twisting disks, the spindles being so placed and the disks on the spindles being so sized and shaped that the disks are interleaved and partially overlapped;

at least one of the spindles and the respective disk set thereon being openable away from the other disk sets for providing an access opening extending parallel to the spindle axes and extending from an exterior point laterally spaced from the spindles, to the center of the disk triangle, for enabling insertion of a thread laterally from the exterior point, past the disks in the disk sets, to the center of the disk triangle for being guided through the false-twisting unit during operation thereof; and driving means for driving the disk sets to rotate, the driving means comprising:

rotation receiving means for being rotated by a prime mover;

a first corner roller located outside the disk triangle; and belt means for interconnecting the rotation receiving means, the first corner roller, and the first, second and third spindles;

the belt means interconnecting the rotation receiving means and the first corner roller for rotating the first corner roller as the rotation receiving means is rotated;

the belt means interconnecting the first corner roller and the first spindle such that rotation of the first corner roller rotates the first spindle and the first disk set thereon;

the belt means interconnecting the first corner roller and the second spindle such that rotation of the first corner roller rotates the second spindle and the second disk set thereon;

the belt means interconnecting the first corner roller and the third spindle such that rotation of the first corner roller rotates the third spindle and the third disk set thereon; and the belt means travelling outside and not obstructing the access opening to the center of the disk triangle, thereby providing unobstructed lateral access for the thread to the center of the disk triangle.

16. The false twisting unit of claim 15, wherein the openable spindle and the respective disk set thereon that are openable away from the other disk sets is one of the first and second spindles and the respective disk set thereon, and the openable spindle is supported to the false twisting unit for being swung away from the other spindles for enabling insertion of a thread through the disk sets with the one disk set open away from the others.

17. The false twisting unit of claim 15, further comprising:

a second corner roller spaced from the first corner roller arid also located outside the disk triangle;

the belt means interconnecting the first and second corner rollers such that the first and second corner rollers rotate together; and the belt means interconnecting the second corner roller and the second spindle.

18. The false twisting unit of claim 17, wherein the belt means comprises a single loop belt driven by the rotation receiving means and passing over the first corner roller, the second spindle and the second corner roller for causing those elements to rotate together.

19. The false twisting unit of claim 18, wherein the belt means comprises a belt extending between the first and second corner rollers and outside the center of the disk triangle.

20. The false twisting unit of claim 15, wherein the first belt connection to the corner roller comprises the rotation receiving means and a first belt between the rotation receiving means and the corner roller; and further comprising a separate bracket, separable from the false twisting unit, the rotation receiving means for driving the corner roller being fastened on the separable bracket for being separated from the false twisting unit with the separable bracket.

21. The false twisting unit of claim 20, further comprising two of the brackets wherein one of the brackets has the drivable disk thereon and the drivable disk is connectable with the drive shaft of the motor, and the other bracket has a drivable disk thereon which is connectable with the drive whorl, and the whorl is engageable with and drivable by a tangential belt.

22. The false twisting unit of claim 15, wherein the rotation receiving means comprises a drive whorl for being rotated by a drive belt.

23. The false twisting unit of claim 15, further comprising a drive motor, and the rotation receiving means comprising a drive shaft of the drive motor.

24. The false twisting unit of claim 23, wherein the rotation receiving means further comprises a rotating disk on the drive shaft.

25. A false-twisting unit comprising:

first, second and third parallel spindles, the spindles having axial centers which define apexes of an equilateral disk triangle having a center, each of the spindles having a respective set of false-twisting disks, the spindles being so placed and the disks on the spindles being so sized and shaped that the disks are interleaved and partially overlapped;

at least one of the spindles and the respective disks set thereon being openable away from the other disk sets for providing an access opening extending parallel to the spindle axes and extending from an exterior point laterally spaced from the spindles, to the center of the disk triangle, for enabling the insertion of a thread laterally from the external point, past the disks in the disk set to the center of the equilateral disk triangle for being guided through the false-twisting unit during operation thereof; and driving means for driving the disk sets to rotate, the driving means comprising:

(a) rotation receiving means for being rotated by a prime mover;

(b) a first drive coupling, comprising at least one separate belt, between the rotation receiving means and the first spindle for rotating the first spindle as the rotation receiving means is rotated, the at least one belt of the first drive coupling travelling entirely outside the center of the disk triangle;

(c) a second drive coupling, comprising at least one separate belt, between the rotation receiving means and the second spindle such that rotation of the rotation receiving means rotates the second spindle and the second disk set thereon, the at least one belt of the second drive coupling travelling entirely outside the center of the disk triangles;

(d) a third drive coupling, comprising at least one separate belt, between the rotation receiving means and the third spindle such that the rotation of the rotation receiving means rotates the third spindle and the third disk set thereon, the at least one belt of the third drive coupling travelling entirely outside the center of the disk triangle; and the respective belts of the first, second and third drive couplings travelling outside and not obstructing the access opening to thereby provide unobstructed laterally access for the thread to the center of the disk triangle.

26. The false-twisting unit of claim 25, further comprising a drive motor, and the rotation receiving means comprising a drive shaft of the drive motor.

27. A false-twisting unit comprising:

first, second and third parallel spindles, the spindles having axial centers which define apexes of an equilateral disk triangle having a center, each of the spindles having a respective set of false-twisting disks, the spindles being so placed and the disks on the spindles being so sized and shaped that the disks are interleaved and partially overlapped;

at least one of the spindles and the respective disks set thereon being openable away from the other disk sets for providing an access opening extending from an exterior point laterally spaced from the spindles, to the center of the disk triangle, for enabling the insertion of a thread laterally from the external point, past the disks in the disk set to the center of the equilateral disk triangle for being guided through the false-twisting unit during operation thereof; and driving means for driving the disk sets to rotate, the driving means comprising:

(a) rotation receiving means for being rotated by a prime mover;

(b) a first drive coupling, comprising at least one belt, between the rotation receiving means and the first spindle for rotating the first spindle as the rotation receiving means is rotated, the at least one belt of the first drive coupling travelling entirely outside the center of the disk triangle;

(c) a second drive coupling, comprising at least one belt, between the rotation receiving means and the second spindle such that rotation of the rotation receiving means rotates the second spindle and the second disk set thereon, the at least one belt of the second drive coupling travelling entirely outside the center of the disk triangles;

(d) a third drive coupling, comprising at least one belt, between the rotation receiving means and the third spindle such that the rotation of the rotation receiving means rotates the third spindle and the third disk set thereon, the at least one belt of the third drive coupling travelling entirely outside the center of the disk triangle; and the respective belts of the first, second and third drive couplings travelling outside and not obstructing the access opening to thereby provide unobstructed lateral access for the thread to the center of the disk triangle; and further comprising:

a first corner roller located outside the disk triangle, wherein the second drive coupling comprises a fourth drive coupling between the rotation receiving means and the first corner roller and a fifth drive coupling between the first corner roller and the second spindle.

28. The false-twisting unit of claim 27 further comprising:

a second corner roller located outside the disk triangle, wherein the third drive coupling comprises a sixth drive coupling between the rotation receiving means and the second corner roller and a seventh drive coupling between the second corner roller and the third spindle.

29. The false-twisting unit of claim 28, wherein the first, fourth and sixth drive couplings together comprises a single loop belt driven by the rotation receiving means and passing over the first corner roller, the first spindle and the second corner roller for causing those elements to rotate together.

30. The false-twisting unit of claim 29, wherein the fifth drive coupling between the first corner roller and the second spindle comprises a belt extending between the first corner roller and said second spindle, the belt travelling entirely outside the center of the disk triangle.

31. The false-twisting unit of claim 30, wherein the seventh drive coupling between the second corner roller and the third spindle comprises a belt extending between the second corner roller and the third spindle and travelling entirely outside the center of the disk triangle.

* * * * *